United States Patent [19]

Reiter

[11] 4,171,334

[45] Oct. 16, 1979

[54] APPARATUS FOR SECURING ASSEMBLY PLATES IN SPRAYING INSTALLATIONS OF HEAT EXCHANGERS

[75] Inventor: Paul Reiter, Hattingen, Fed. Rep. of Germany

[73] Assignee: Balcke-Dürr Aktiengesellschaft, Ratingen, Fed. Rep. of Germany

[21] Appl. No.: 887,661

[22] Filed: Mar. 17, 1978

[30] Foreign Application Priority Data

Mar. 23, 1977 [DE] Fed. Rep. of Germany ..... 2712702

[51] Int. Cl.[2] ..... B01F 3/04

[52] U.S. Cl. ..... 261/112; 261/DIG. 11; 428/98; 428/101

[58] Field of Search ..... 261/112, DIG. 11, DIG. 72; 165/8–10, 60, 166; 428/183, 182, 98, 99, 101

[56] References Cited

U.S. PATENT DOCUMENTS

| | | | |
|---|---|---|---|
| 2,042,127 | 5/1936 | Sayles | 261/DIG. 11 |
| 2,197,970 | 4/1940 | Elmer | 261/DIG. 11 |
| 2,661,197 | 12/1953 | Norman | 261/112 |
| 2,836,405 | 5/1958 | Hamon | 261/112 |
| 3,151,675 | 10/1964 | Lysholm | 261/112 X |
| 3,345,048 | 10/1967 | Phelps | 261/112 |
| 3,378,239 | 4/1968 | Engalitcheff, Jr. et al. | 261/DIG. 11 |
| 3,643,931 | 2/1972 | Henning et al. | 261/112 X |

FOREIGN PATENT DOCUMENTS

| | | | |
|---|---|---|---|
| 550406 | 1/1943 | United Kingdom | 261/DIG. 11 |

*Primary Examiner*—Richard L. Chiesa
*Attorney, Agent, or Firm*—Martin A. Farber

[57] ABSTRACT

An apparatus for securing assembly plates in washing or spraying installations of heat exchangers, particularly cooling towers, with at least two layers of vertical assembly plates, with the layers being disposed one above the other and the assembly plates in each layer, respectively, being arranged parallel to one another, and from layer to layer at a predetermined spacing as well as at a predetermined angle with respect to each other. A spacer is arranged diagonally to the angularly crossing assembly plates, which spacer is provided with lower and upper guide slots under the circumstances oriented at half the crossing angle with respect to its longitudinal extent. The guide slots of each set run parallel to one another. The upper and lower guide slots respectively run in the crossing angle relative to each other and have contact surfaces respectively formed spaced apart corresponding to the predetermined spacing of the assembly plates of the layers which are disposed one above the other.

12 Claims, 6 Drawing Figures

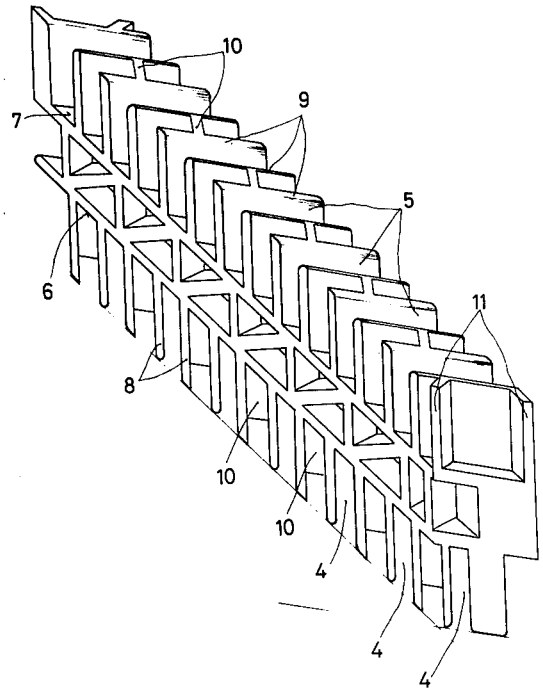

APPARATUS FOR SECURING ASSEMBLY PLATES IN SPRAYING INSTALLATIONS OF HEAT EXCHANGERS

BACKGROUND OF THE INVENTION

The invention relates to an apparatus for securing assembly plates in washing or spraying installations of heat exchangers, particularly cooling towers, with at least two layers of vertical assembly plates, which layers of assembly plates are arranged one above the other, the assembly plates in each layer respectively being arranged parallel to one another and from layer to layer being arranged spaced as well as at a predetermined crossing angle with respect to each other.

Devices of the previously described type are known from U.S. Pat. No. 2,661,197. They consist of a type of clip (called a distance piece in the patent) which on its lower side and upper side, respectively, are each provided with a slot; these slots run at right angles to one another and secure the lower edge of an upper disposed assembly plate in relationship to the upper edge of an assembly plate which is located thereunder.

This known device is considered disadvantageous since with such a type of clip respectively only two plates can be mutually secured, so that a plurality of such type of clip must be provided, which can only be done with great expense. An extension of the individual clips for simultaneous securing of several assembly plates is not possible, since in this case there would result a rail running across the entire length of the lower assembly plate, which would considerably eliminate the hydraulic and thermodynamic efficiency or activity of the lower plate, since this plate could not be applied with coolant or cooling liquid on the upper edge.

It is an object on which the present invention is based, to provide an apparatus for securing of assembly plates in scrubbing or spraying assemblies of the introductory-mentioned type, which with a simplest assembly or installation permits the securing of a plurality of assembly plates relative to one another without impairment of the efficiency.

STATEMENT OF THE INVENTION

It is another object of the present invention, to aid in the solution of the above-mentioned object, in a manner by means of a range spacer (3) arranged diagonally to the angularly crossing assembly plates (1, 2), which spacer under the circumstances from time to time at half the crossing angle relative to its longitudinal extent is provided with lower and upper guide slots (4, 5), the guide slots running mutually parallel to one another and running at the crossing angle relative to one another and their contact surfaces (6, 7) are formed spaced apart corresponding to the predetermined spacing of the assembly plates (1, 2) of the layers which re disposed one above the other.

With this proposal in accordance with the present invention a spacer is provided by which several assembly plate layers which lie spaced one above the other and angularly with respect to one another are secured only respectively under the circumstances at a narrow place mutually with respect to one another in such a manner that the thermodynamic and hydraulic operation or effect is not measurably impaired and nevertheless a predetermined spacing relationship in the horizontal and vertical direction is exactly maintained. By the securing of several assembly plates by a common spacer, moreover the assembly or installation is considerably simplified.

According to a further feature of the invention the guide slots (4, 5) each are formed respectively under the circumstances by two guide plates (8, 9), and the latter on their back side are connected to means of a stay or web (10) with the adjacent guide plate (8, 9). In this manner in spite of the simplest formation, a good rigidity is achieved. The formation and division of the upper and the lower guide slots can be executed the same or differently; the formation is independent of the respective height of the assembly plates under the circumstances from time to time, which height likewise can be the same or different.

With a preferred embodiment of the invention, on each last guide plate (4, 5) of the range spacer (3) there is formed an abutment or contact surface (11) for an identically or similarly formed spacer (3), such that the spacers can be arranged or coordinated contiguously abutting each other in one line. It is also possible incidentally to arrange the spacers laterally off-set or displaced relative to each other and with a corresponding overlapping.

BRIEF FIGURE DESCRIPTION

With the above and other objects and advantages in view, the present invention will become more clearly understood in connection with the following detailed description of a preferred embodiment, when considered with the accompanying drawings, of which:

DETAILED DESCRIPTION OF PREFERRED EMBODIMENT

Figure 1:
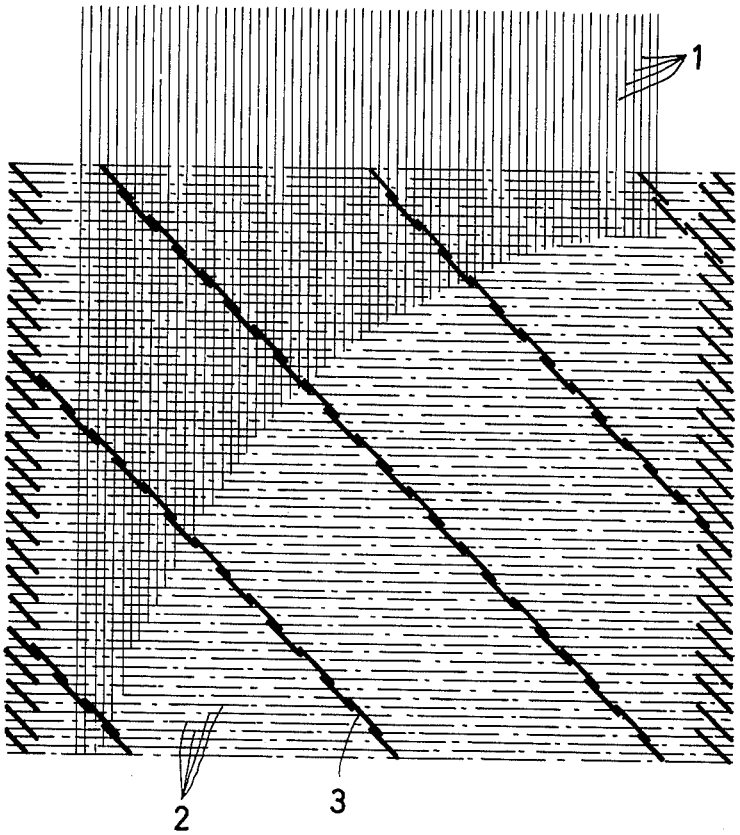
FIG. 1 is a schematic plan view of two layers of assembly plates in washing or spraying installations, the plates crossing perpendicularly, the assemblies being secured to one another with the use of diagonally arranged spacers.

The schematic illustration in FIG. 1 shows the plan view of a lower layer of assembly plates 1 which are arranged parallel to one another, on which a plurality of range spacers 3 are positioned or mounted. These spacers 3 on the one hand serve to hold the assembly plates 1 on their upper edge (i.e., the edge illustrated in FIG. 1) at a predetermined spacing relative to each other and on the other hand serve to secure the lower edges of the assembly plates 2 with respect to the assembly plates 1. These assembly plates 2 are located spaced above the assembly plates 1 and extend in the illustrated embodiment at right angles thereto. Likewise, the assembly plates 2 mutually maintain the same spacing relative to each other.

Figure 2:
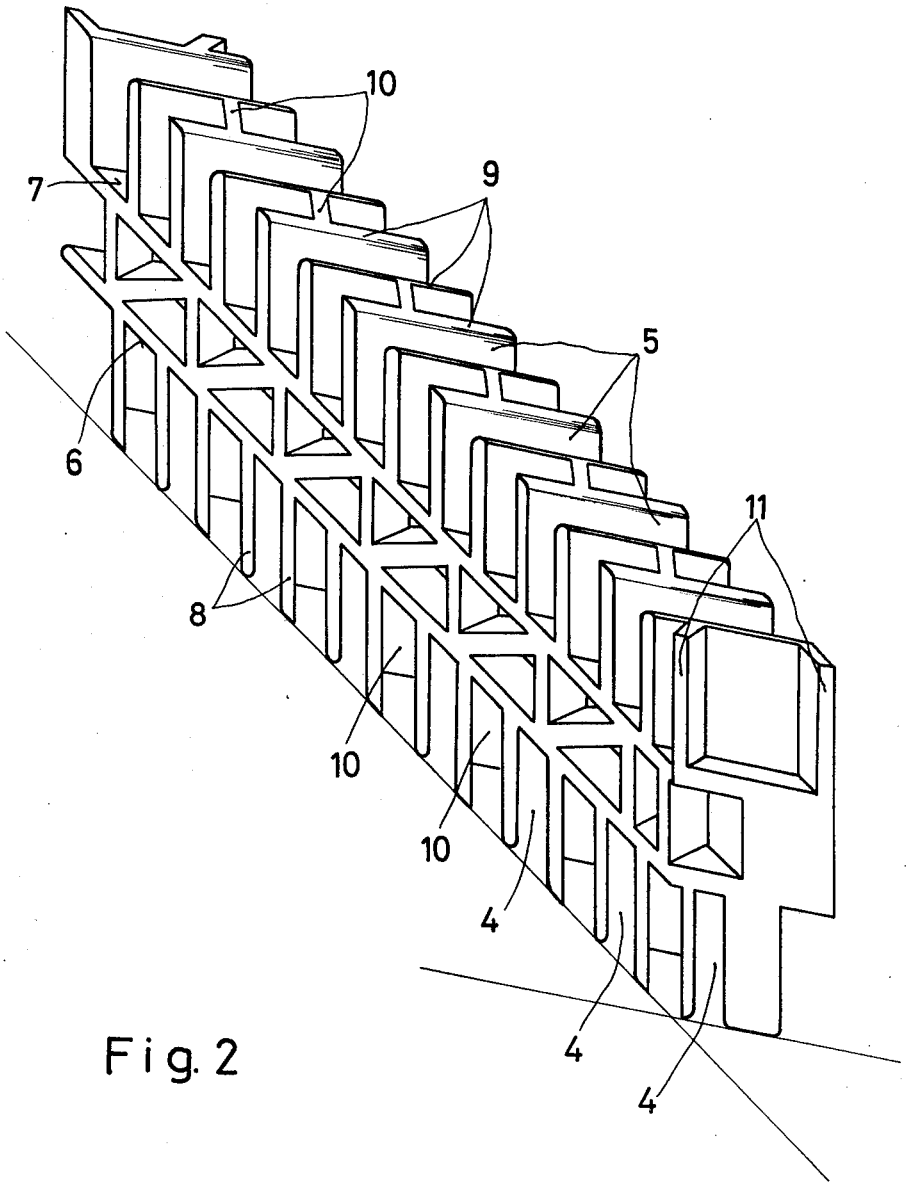
FIG. 2 is a perspective view of one spacer used in FIG. 1.

The range spacer 3 which is illustrated in perspective view in FIG. 2 is produced in one piece, integrally of non-rusting or non-corroding or non-corrosive material, preferably a synthetic material or plastic. Instead of synthetic material also it may be produced of wood, ceramic, asbestos or nobel metals.

Figure 3:
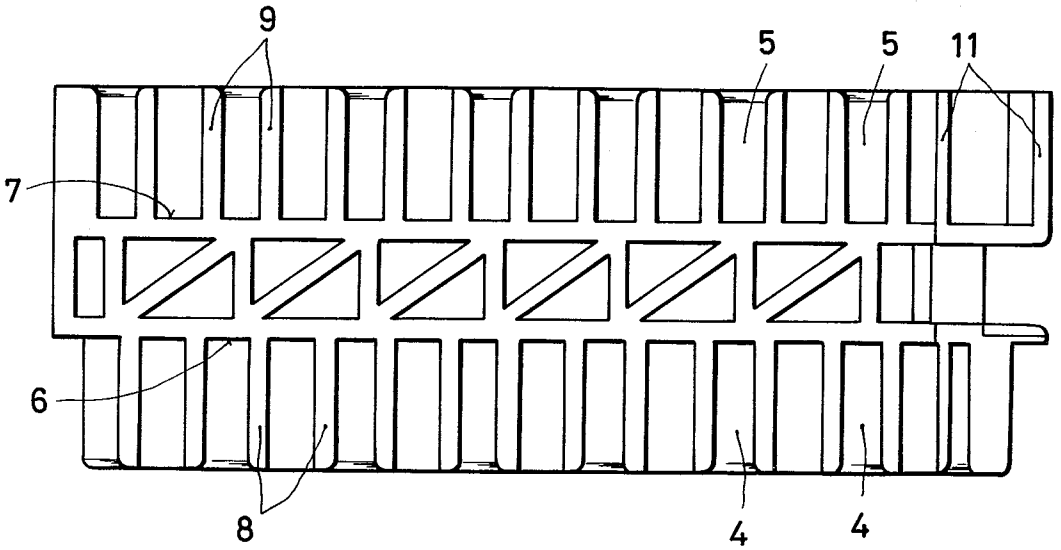
FIG. 3 is a side view of the spacer according to FIG. 2.

The range spacer 3, which is to be arranged diagonally to the perpendicularly crossing assembly plates 1 and 2, is provided with a number of lower guide slots 4 as well as a corresponding number of upper guide slots 5, which respectively under the circumstances are formed by and between two spaced guide plates 8 and 9, respectively. The upper guide slots 5 run at right angles relative to the lower guide slots 4, as shown by a comparison between FIGS. 4 and 5. Respective adjacent guide plates 8 and 9, which do not form any guide slot therebetween, are connected with one another by means of a web or stay 10 for reinforcement or rigidifying, the webs 10 being perpendicular to and centrally located relative to adjacent spaced pairs of guide plates, a pair of guide plates being defined as those forming a guide slot therebetween. The distance or the spacing between a contact or base abutment engagement surface 6 of the lower guide slots 4 and a contact or base abutment engagement surface 7 of the upper guide slots 5 corresponds to the distance to be maintained between the lower edge of the upper assembly plates 2 and the upper edge of the lower assembly plates 1. Between the respective contact surfaces 6 and 7, there is a center reinforcing and spacing matrix formed of vertical spaced apart walls and diagonal wall members connected between the spaced horizontal walls forming the respective contact surfaces 6 and 7, respectively (FIG. 3).

The assembly or installation of the spacers 3 takes place in a simple manner, in that the latter are slipped on the upper edge of the assembly plates 1 in the diagonal direction, as this is shown for example in FIG. 1. Finally the upper assembly plates 2 which are illustrated in dot-dashed lines are applied or pressed-on, the assembly plates 2 being held by the spacers 3 at the predetermined position in relationship to the lower assembly plates 1.

Figure 4:
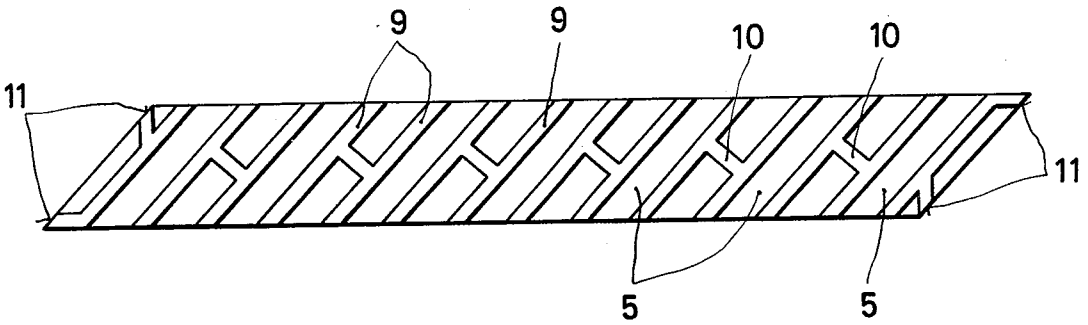
FIG. 4 is a plan view of the spacer according to FIGS. 2 and 3.
Figure 5:
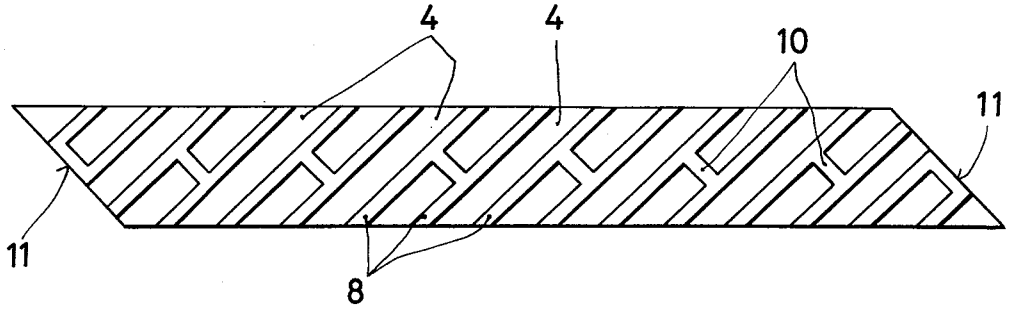
FIG. 5 is a bottom view of the spacer according to FIGS. 2–4.
Figure 6:
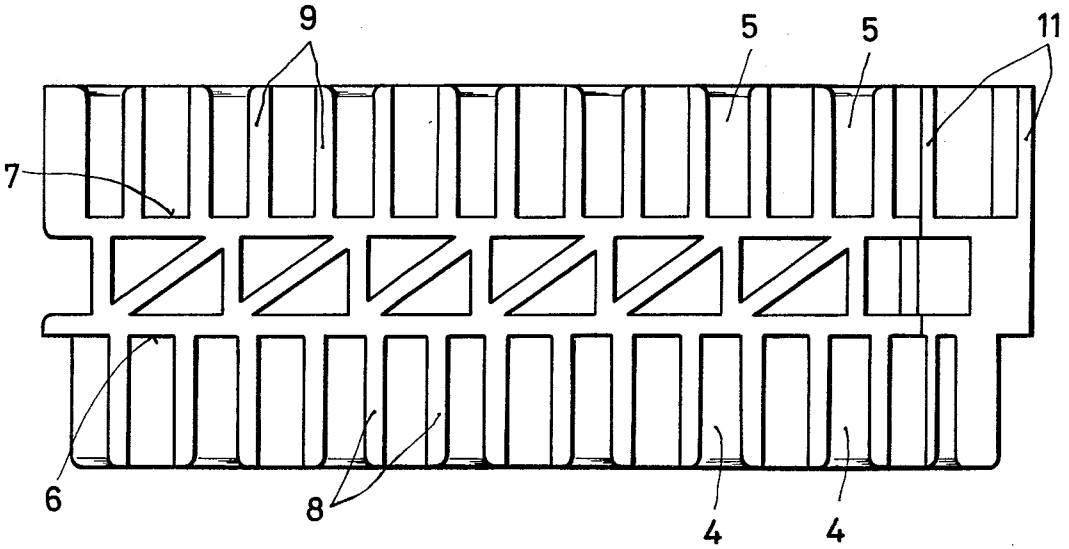
FIG. 6 is a rear side view of the spacer in FIG. 2.

The overall longitudinal plan shape of the spacer as shown in FIGS. 4 and 5 is a parallelogram, although not limited thereto.

In order to be able to arrange a plurality of spacers 3 in one line, linearly one behind the other, respectively, under the circumstances the last, end guide plates 4, 5 of a spacer 3 is provided with an engagement or abutment surface 11, such that similar or identically formed spacers 3 are able to be joined or assembled. The surfaces 11 are formed on the lateral ends of projections which preferably are substantially shaped in cross-section as illustrated, these projections being inverted on the opposite ends of each spacer 3, respectively. The surfaces 11 are shown lying flush along the lateral as well as adjacent the longitudinal edges of the spacer 3.

Of course the assembly plates 1 and 2 also could cross at an angle different than 90°. In this case the spacers 3 extend lengthwise relative to the assembly plates 1 and 2, respectively, at half the angle of crossing of the plates 1 and 2 relative to each other, i.e., the spacers 3 extend in a direction relative to both assembly plates 1 and 2 at an angle simultaneously half-way between both of the respective directions of the assembly plates 1 and 2. Correspondingly then the guide slots 4 and 5 are angularly aligned relative to one another by the same crossing angle of the plates 1 and 2, and preferably each of the guide stops 4 and 5, respectively, is angularly equidistant relative to the lengthwise or longitudinal extent of the spacer 3 and at opposite crossing directions relative thereto, i.e., each of the slots 4 and 5 defining an angle equal to half the crossing angle relative to the longitudinal extent or axis of the spacer and at opposite crossing directions relative thereto.

Angles other than half relative to the crossing angle may possibly be used for the spacer and the guide slots. If the angles of the guide slots 4 and 5 relative to the longitudinal extent of the spacer are equal (or in a ratio x:y), then the spacer bisects (or intersects in the same ratio x:y) the angle of crossing of the crossing assembly plates 1 and 2, and visa versa, i.e., one condition is a necessary and sufficient condition of the other. Naturally in any case the angle between the guide slots 4 and 5 must equal the crossing angle between the assembly plates 1 and 2, which assembly plates are disposed in the respective guide slots.

While I have disclosed several embodiments of the invention it is to be understood that these embodiments are given by example only and not in a limiting sense.

I claim:

1. An apparatus for securing of assembly plates in spraying installations of heat exchangers, particularly cooling towers, with at least two layers of vertical assembly plates, which layers are disposed one above the other, the assembly plates in each layer respectively being arranged parallel to each other, and from layer to layer are arranged at a predetermined spacing as well as at a predetermined angle with respect to one another, comprising a spacer defining a longitudinal extent and adapted to be arranged diagonally relative to the angularly crossing assembly plates, said spacer including portions forming a plurality of lower guide slots and a plurality of upper guide slots, respectively, said upper guide slots running mutually parallel to each other, said lower guide slots running mutually parallel to each other, said upper guide slots running at a crossing angle relative to said lower guide slots, said portions include contact surfaces, respectively, of said upper and said lower guide slots, respectively, said contact surfaces, respectively being spaced from each other corresponding to the predetermined spacing of the assembly plates of the two layers which are disposed one above the other.

2. The apparatus as set forth in claim 1, wherein said portions include a plurality of pairs of adjacent spaced guide plates, respectively, each of said pairs of said spaced guide plates forms one of said guide slots between said spaced guide plates thereof, said pairs of said guide plates are spaced from and adjacent to each other, a web is connected to and between adjacent of said pairs, said web is connected to and between adjacent ones of said guide plates of adjacent of said pairs, respectively.

3. The apparatus as set forth in claim 1 or 2, wherein each of said lower guide slots and said upper guide slots is oriented non-parallel to said longitudinal extent of said spacer.

4. The apparatus as set forth in claim 2, wherein said guide plates include end guide plates on ends of said spacer, an abutment surface means formed on each said end guide plate of said spacer abutting an abutment surface means of another similar spacer.

5. The apparatus as set forth in claim 1, wherein said portions form and partition said upper and said lower guide slots equally.

6. The apparatus as set forth in claim 1, wherein said portions form and partition said upper and lower guide slots differently.

7. The apparatus as set forth in claim 1, wherein said spacer is integrally formed of a non-corrosive material.

8. The apparatus as set forth in claim 7, wherein said non-corrosive material is synthetic material.

9. The apparatus as set forth in claim 1, wherein said crossing angle between said upper and lower guide slots is equal to the predetermined angle of crossing of the two assembly plates of the two layers which are disposed one above the other.

10. The apparatus as set forth in claim 9, wherein each of said lower guide slots and said upper guide slots is oriented at half said crossing angle relative to said longitudinal extent of said spacer.

11. The apparatust as set forth in claim 9, wherein said spacer is oriented at half said crossing angle relative to said longitudinal extent.

12. The apparatus as set forth in claim 9, further comprising a plurality of the assembly plates forming two layers of assembly plates, respectively disposed one above the other at said predetermined angle of crossing relative thereto, said spacer being diagonally arranged relative to said assembly plates, one of said layers of assembly plates is disposed with said assembly plates thereof mounted in said upper guide slots, respectively, and the other of said layers of assembly plates is disposed with the latter said assembly plates thereof mounted in said lower guide slots.

* * * * *